US005915859A

United States Patent [19]

Kubota et al.

[11] Patent Number: 5,915,859

[45] **Date of Patent: *Jun. 29, 1999**

[54] PIVOTABLE INK RIBBON CASSETTE AND A PRINTER

[75] Inventors: Masayuki Kubota; Junji Akutsu; Masaru Sugie; Chiaki Sekioka; Yasuhiro Ite, all of Inagi, Japan

[73] Assignee: Fujitsu Limited and Fujitsu Isotec Limited, Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/878,120

[22] Filed: Jun. 18, 1997

[30] Foreign Application Priority Data

Dec. 27, 1996 [JP] Japan ..... 8-351170

[51] Int. Cl.[6] ..... B41J 35/14

[52] U.S. Cl. ..... 400/213; 400/208; 400/216; 400/202

[58] Field of Search ..... 400/194, 195, 400/196, 196.1, 207, 208, 208.1, 213, 217, 213.1, 232, 224, 216, 197, 200, 202, 202.1, 202.2, 202.4

[56] References Cited

U.S. PATENT DOCUMENTS

| | | | |
|---|---|---|---|
| 3,348,650 | 10/1967 | Meinherz et al. | 400/232 |
| 4,132,486 | 1/1979 | Kwan | 400/213 |
| 4,347,007 | 8/1982 | Schaefer | 400/208 |
| 4,352,577 | 10/1982 | Chida et al. | 400/196.1 |
| 4,697,942 | 10/1987 | Yagi et al. | 400/208 |
| 4,770,553 | 9/1988 | Deschamps et al. | 400/208 |
| 4,867,585 | 9/1989 | Dirla | 400/208 |
| 5,067,833 | 11/1991 | Gomoll et al. | 400/213 |
| 5,224,785 | 7/1993 | Raar | 400/213 |

FOREIGN PATENT DOCUMENTS

| | | | |
|---|---|---|---|
| 1208152 | 7/1986 | Canada | 400/208 |
| 0 510 745 A1 | 4/1992 | European Pat. Off. . | |
| 62-161580 | 7/1987 | Japan | 400/208 |
| 2-32862 | 2/1990 | Japan | 400/208 |
| 3-83682 | 4/1991 | Japan | 400/208 |
| 4-28581 | 1/1992 | Japan | 400/208 |
| 6-143776 | 5/1994 | Japan | 400/208 |
| 5-135513 | 12/1994 | Japan | 400/213 |
| 2091685 | 8/1982 | United Kingdom | 400/208 |
| WO 85 05326 A | 12/1985 | WIPO . | |

OTHER PUBLICATIONS

Galbraith, R.J.: "Bevel drive gear" IBM Technical Disclosure Bulletin, vol. 27, No. 1a, Jun. 1984, New York, pp. 253–255, XP002058418.

*Primary Examiner*—Christopher A. Bennett
*Attorney, Agent, or Firm*—Armstrong, Westerman, Hattori, McLeland & Naughton

[57] ABSTRACT

An ink ribbon cassette is pivotably mounted to a printer. Ink ribbon is accommodated in the ink ribbon cassette and is caused to travel by a ribbon feed roller driven by a drive shaft provided in the printer. Printing operation is carried out at the cassette end arm portion by a printing head, while the cassette end arm portion is reciprocatingly moved in the widthwise direction of the ink ribbon relative to the fixed printing head by an actuating mechanism so that a printing region of the ink ribbon is diffused and becomes wider than a printing width of the printing head. The actuating mechanism includes a small gear integral with the ribbon feed roller, a cam driven by the small gear, and a lever engaging with the cam.

20 Claims, 10 Drawing Sheets

PIVOTABLE INK RIBBON CASSETTE AND A PRINTER

BACKGROUND OF THE INVENTION

1. Field of the Invention

The present invention relates to a printer for printing information such as images or letters in a personal computer or a word processor onto paper, and an ink ribbon cassette mounted to the printer.

2. Description of the Related Art

A wire dot impact printer has an ink ribbon cassette mounted thereto. The ink ribbon cassette has an ink ribbon accommodated therein, and an ink ribbon made of a fabric such as a nylon fiber fabric is typically used. Since the base fabric material of the fabric ink ribbon has good ink permeability, the fabric ink ribbon can be repeatedly used while supplying ink to the fabric base material, so an operational life of the ink ribbon can be prolonged.

When the ink ribbon is being used in this manner, the fibers of the base fabric material of the ink ribbon are severed little by little due to impacts by printing pins and the base fabric material becomes fluffy. If this phenomena develops, the base fabric material is perforated and broken, so the printing quality is deteriorated and the ink ribbon feeding mechanism is affected. The operational life of the ink ribbon is thus reduced. In order to prolong the operational life of the ink ribbon, it is effective to elongate the length of the ink ribbon so that frequency of the use of the particular portion of the ink ribbon is reduced.

For accomplishing this, there is an "installed type" ink ribbon cassette in which the ink ribbon cassette is installed to the printer so as to straddle on left and right frames of the printer. The ink ribbon cassette of this type can have a large capacity for ink ribbon, and it can, in fact, accommodate 20 to 90 meters of ink ribbon. However, since the installed type ink ribbon cassette is large in size and expensive, a small "mounted type" ink ribbon cassette which is mounted to the carrier of the printer and is reciprocatingly movable with the printing head is often used. However, the width of the mounted type ink ribbon cassette is considerably restricted and the accommodating capacity for the ink ribbon is small, so it can only accommodate 5 to 10 meters of ink ribbon.

Conventionally, the mounted type ink ribbon cassette is mainly used in a printer for the low-end market, so that light-duty printing is required and an elongated operation life is not necessary. However, recently, the mounted type ink ribbon cassette has more and more been used in a middle or high-end printer, so it is required for the mounted type ink ribbon cassette to provide higher printing performance (printing velocity, printing pressure and so on) and an prolonged operational life to carry out a lot of printing such as printing slips.

In addition, in the case where a conventional printer including an installed type ink ribbon cassette was on the market and a new model printer is introduced to replace the conventional printer, if the new model printer is designed to include a mounted type ink ribbon cassette, the following demerits appear; the operational life of the ink ribbon is reduced, the frequency of changing the ink ribbon is higher, and the running cost increases. Therefore, regarding the mounted type ink ribbon cassette, it is necessary to increase the durability and to prolong the operational life thereof.

SUMMARY OF THE INVENTION

The object of the present invention is to provide an ink ribbon cassette and a printer mounting such an ink ribbon cassette, in which the operational life of an ink ribbon is prolonged even if the capacity for accommodating the ink ribbon is relatively restricted.

According to the present invention, there is provided an ink ribbon cassette comprising a cassette body having an ink ribbon accommodated therein, said cassette body having a cassette end arm portion for guiding the ink ribbon for a printing operation by a printing head, and an actuating mechanism for moving the cassette end arm portion in the widthwise direction of the ink ribbon relative to the printing head so that a printing region of the ink ribbon which is wider than a printing width of the printing head can be used in a printing operation.

In this arrangement, the printing region of the ink ribbon is widthwise diffused, and the number of the impact on a particular portion of the ink ribbon by the printing pins is reduced while the ink ribbon is repeatedly used, and an operational life of the ink ribbon is prolonged.

Preferably, the cassette body is pivotally attached to a base as a portion of a printer, and has a ribbon feed roller for causing the ink ribbon to travel, said actuating mechanism being arranged to receive a rotational force from a ribbon actuating means of the printer to pivotably move said cassette body, so that the printing region of the ink ribbon is widthwise diffused by pivotably moving said cassette body in the widthwise direction of the ink ribbon.

Since the actuating mechanism for pivotably moving the cassette body to widthwise diffuse the printing region of the ink ribbon functions by receiving a rotational force from the printer, it is not necessary to add a special motor or solenoid to pivotably move the cassette body. Also, since the actuating mechanism can use an existing element such as a ribbon feed roller, the arrangement of the actuating mechanism for pivotably moving the cassette body is simple. Also, since the actuating mechanism can be incorporated in the cassette body, it is not necessary to modify the printer itself, and it is possible to mount the ink ribbon cassette according to the present invention to a printer, in place of a conventional ink ribbon cassette having no such actuating mechanism.

In this case, preferably, the actuating mechanism comprises a small gear provided on a shaft of said ribbon feed roller, a cam having a gear engaging with the small gear, and a lever engaging with the cam. In this case, preferably, the small gear is integrally formed with the ribbon feed roller and the shaft, the cam is formed as a disk-like cam having the gear on the periphery thereof and a cam surface on one surface thereof, and the lever perpendicularly follows the cam surface. Also, it is possible to arrange such that the lever has a portion adapted to abut against the cam surface and another portion adapted to abut against the base.

Preferably, the cassette body has a driven roller cooperating with the ribbon feed roller to feed the ink ribbon into a ribbon accommodating chamber in the cassette body, the driven roller having a shaft over which a central hole of the cam is freely fitted. Alternatively, the cassette body has a driven roller cooperating with the ribbon feed roller to feed the ink ribbon into a ribbon accommodating chamber in the cassette body and a fixed ring-shaped sleeve, the sleeve being arranged between a shaft of the driven roller and a central hole of the cam so that the interior side of the sleeve acts as a bearing for the shaft of the driven roller and the exterior side of the sleeve acts as a shaft for supporting the cam. Preferably, the small gear has circumferentially discontinuous teeth and a non-toothed portion between the teeth.

Preferably, the cam surface has a higher portion and a lower portion with vertical connecting portions between the higher and lower portions. Alternatively, the cam surface has a higher portion and a lower portion with sloped connecting portions between the higher and lower portions. Preferably, in this case, viewed in the rotational direction of the cam surface, the sloped connecting portion extending from the lower portion to the higher portion is longer than the sloped connecting portion extending from the higher portion to the lower portion.

Preferably, the cassette body has an ink supply member having ink contained therein, the ink supply member having a width smaller than the width of the printing region of the ink ribbon. Alternatively, the cassette body has an ink supply member having ink contained therein and the ink ribbon is formed in a loop, the ink supply member being arranged to supply ink to the interior side of the loop of the ink ribbon.

Preferably, the ink ribbon comprises an ink ribbon base fabric woven from chemical fibers in a seamless form and ink impregnated in the ink ribbon base fabric.

Preferably, the actuating mechanism comprises a cam provided in an element attached to a shaft of the ribbon feed roller, and a projection provided on an upper wall of the cassette body.

Preferably, the element having the cam comprises a knob fixedly fitted on a shaft of the ribbon feed roller.

In addition, the present invention provides a printer comprising an ink ribbon cassette, a base supporting said ink ribbon cassette, and a printing head. The base has a pivotable support portion for pivotably supporting the ink ribbon cassette, a support portion for supporting the ink ribbon cassette at a position different from the pivotable support portion, and a ribbon actuating means. The ink ribbon cassette includes a cassette body pivotably mounted to the base at the pivotable support portion, a ribbon feed roller rotated by the ribbon actuating means for causing the ink ribbon to travel, a cassette end arm portion for guiding the ink ribbon for a printing operation by the printing head, and an actuating mechanism arranged in the cassette body to receive a rotational force from the ribbon actuating means of the printer to pivotably move the cassette body, whereby a printing region of the ink ribbon is widthwise diffused by pivotably moving the cassette body in the widthwise direction of the ink ribbon relative to the fixedly arranged printing head.

This printer includes the features of the above described ink ribbon cassette. Therefore, the printing region of the ink ribbon is widthwise diffused, so the number of impacts on the identical portion of the ink ribbon by the printing pin is reduced even if the ink ribbon is repeatedly used, and an operational life of the ink ribbon is prolonged.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
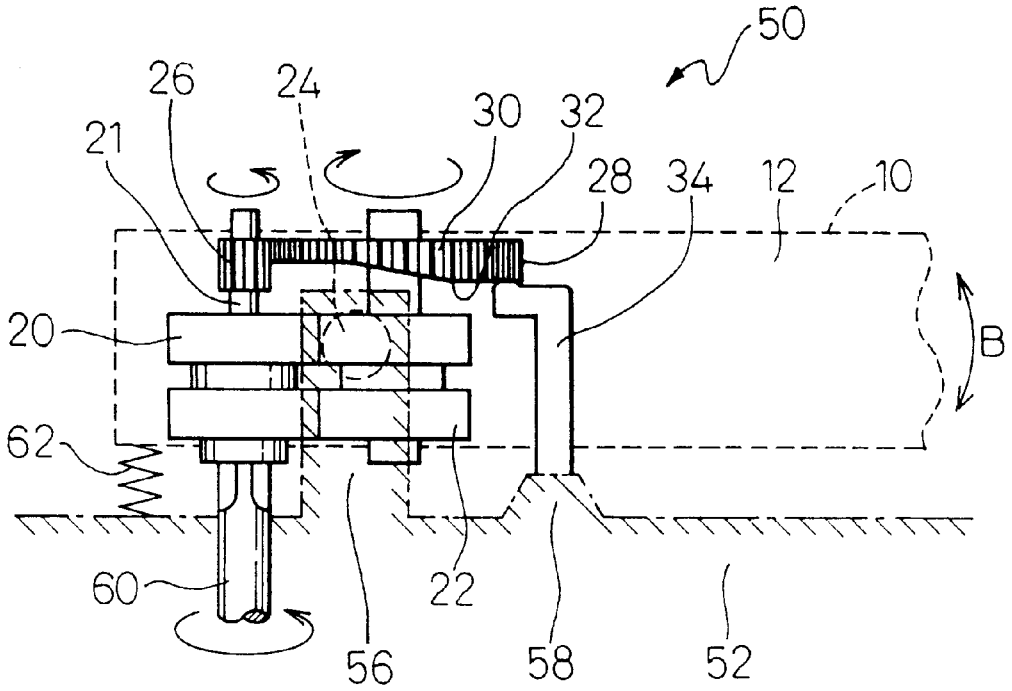
FIG. 1 is a diagrammatic view of a printer having an ink ribbon cassette according to the first embodiment of the present invention.
Figure 2:
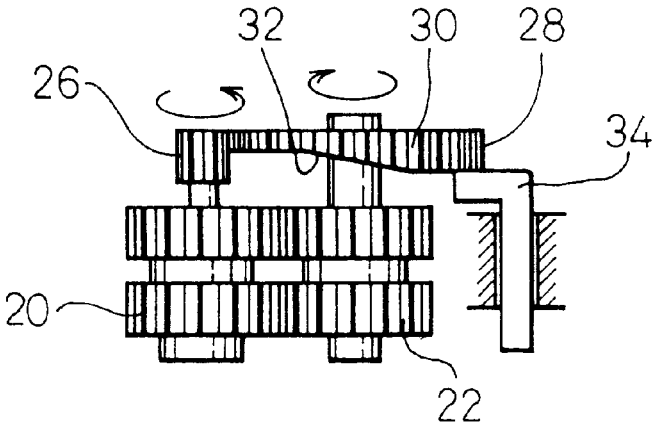
FIG. 2 is a view of an actuating mechanism provided in the cassette body of FIG. 1.
Figure 3:
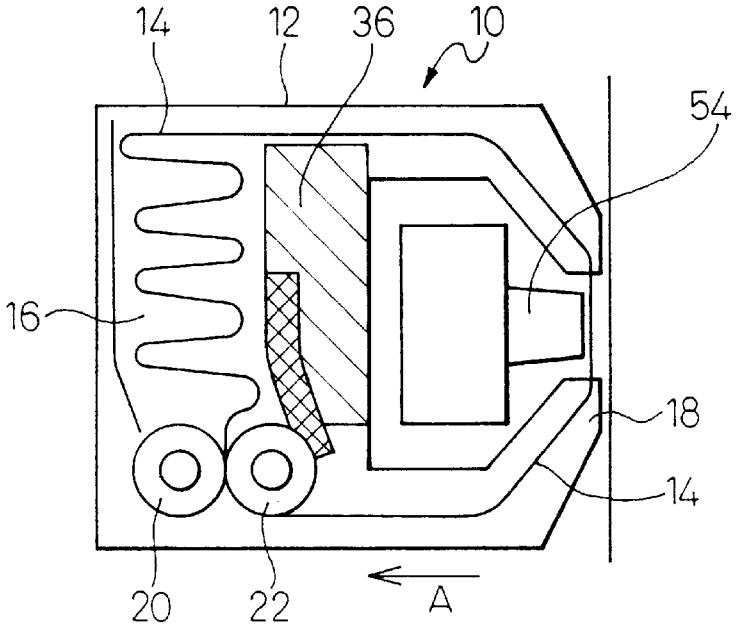
FIG. 3 is a plan view of the ink ribbon cassette of FIG. 1.

FIGS. 1 to 5 shows a printer 50 having an ink ribbon cassette according to one embodiment of the present invention. The printer 50 has a carrier or a carriage which can reciprocatingly move in the transverse direction of the printer, and a base 52 which is a part of the carriage. The printer 50 has an ink ribbon cassette 10 and a printing head 54 (FIG. 3).

The ink ribbon cassette 10 has a cassette body 12 and an ink ribbon 14 accommodated in the cassette body 12. The cassette body 12 has an ink ribbon accommodating chamber 16, a cassette end arm portion 18 including a gap, and a pair of ink feed rollers 20 and 22, as shown in FIG. 3. The ink ribbon 14 is caused to travel in the direction of the arrow A by the ink feed rollers 20 and 22, and printing operation is carried out onto a paper at the cassette end arm portion 18 by the printing head 54. The ink ribbon used for printing 14 is fed into the ink ribbon accommodating chamber 16 and accommodated therein in a folded condition.

The ink ribbon cassette 10 is a mounted type ink ribbon cassette and is small compared with an installed type ink ribbon cassette. Therefore, the length of the available ink ribbon 14 is relatively short, for example, several to 10 meters. Therefore, it is necessary that a relatively short ink ribbon can be used with a good durability. The ink ribbon 14 is preferably comprises a loop of a fabric in a seamless form. The ink ribbon 14 thus comprises an ink ribbon base fabric woven from chemical fibers in a seamless form and ink impregnated in the ink ribbon base fabric. In contrast, there is another type of ink ribbon in which ends of the ribbon base material are thermally seamed together to form a loop, but the seamed ink ribbon tends to be damaged at the seamed ends and the operational life thereof is short. In addition, in the case of the seamed ink ribbon, it is possible to accommodate the ink ribbon in the form of a Möbius strip so that the upper part and the lower part of the ink ribbon can be respectively used for printing operation. However, the seamless loop ink ribbon cannot take the form of a Möbius strip.

In FIGS. 1 and 2, the base 52 of the printer 50 has a pivotable support portion 56 for pivotably supporting the ink ribbon cassette 10, a support portion 58 for supporting the ink ribbon cassette 10 at a position different from the pivotable support portion 56, and a ribbon actuating means 60. A pin 24 laterally projects from the side surface of the cassette body 12, and the pivotable support portion 56 has a hole to receive the pin 24. Therefore, the ink ribbon cassette 10 is pivotable about an axis of the pin 24 relative to the base 52. A spring 62 biases the ink ribbon cassette 10 at a position opposite from the support portion 58 from pivotable support portion 56.

One roller 20 of the pair of the ribbon feed rollers 20 and 22 in the cassette body 12 is a drive roller, and the other roller 22 is a driven roller which is driven by the drive roller 20. The ribbon feed rollers 20 and 22 are gear-shaped rollers having teeth on their periphery, the teeth of the ribbon feed rollers 20 and 22 mesh with each other with the ink ribbon 14 passed therebetween to convey the ink ribbon 14. The ribbon actuating means 60 of the printer 50 is a drive shaft which is fitted in the hole of the ribbon feed roller 20 when the ink ribbon cassette 10 is mounted to the printer 50. The ribbon actuating means 60 is driven by a motor arranged in the printer 50.

An actuating mechanism is arranged in the cassette body 12 for pivotably moving the cassette body 12. This actuating mechanism is arranged to receive a rotational force from the ribbon actuating means 60 of the printer 50 to pivotably move the cassette body 12. In particular, this actuating mechanism comprises a small gear 26 provided on a shaft 21 of the ribbon feed roller 20, a cam 30 having a gear 28 engaging with the small gear 26, and a lever 34 engaging with the cam 30.

The small gear 26 is integrally formed with the ribbon feed roller 20 and its shaft 21, and rotates with the ribbon feed roller 20. The cam 30 is formed as a disk-like cam having the gear 28 on the periphery thereof and a cam surface 32 on the lower surface thereof. Therefore, when the small gear 26 rotates, the cam 30 also rotates. The lever 34 is arranged to perpendicularly follow the cam surface 32. That is, the lever 34 has an upper end adapted to abut against the cam surface 32 and a lower end adapted to abut against the support portion 58 of the base 52. The cassette body 12 includes an upper wall (for example, 38 in FIG. 5) located on the upper side of the cam 30, so the cassette body 12 moves upward when the cam 30 moves upward.

Therefore, the rotation of the ribbon actuating means 60 is transferred to the cam 30 through the ribbon feed roller 20 and the small gear 26, and the cam 30 rotates. Since the lower end of the lever 34 abuts against the support portion 58 of the base 52, the lever 34 does not vertically move. During the rotation of the cam 30, when a higher portion of the cam surface 32 engages with the lever 34, the cassette body 12 (the cassette end arm portion 18) pivotably moves upward about the pin 24, and when a lower portion of the cam surface 32 engages with the lever 34, the cassette body 12 (the cassette end arm portion 18) pivotably moves downward about the pin 24. The ink ribbon cassette 10 pivotably moves cyclically, as shown by the arrow B in FIG. 1.

The pivoting direction of the ink ribbon cassette 10 corresponds to the widthwise direction of the ink ribbon 14. The pin 24 defining a center of the pivot motion is located near the ribbon feed roller 20 and the cassette end arm portion 18 is located at the end of the cassette body 12 which is most remote from the ribbon feed roller 20. Therefore, the cassette end arm portion 18 can move sufficiently vertically in the widthwise direction of the ink ribbon 14 even if the difference between the upper and lower portions of the cam surface 32 is small.

The printing head 54 is arranged at a fixed position, as shown in FIG. 3. When the cassette end arm portion 18 vertically moves, i.e., perpendicular to the sheet of FIG. 3, a portion of the ink ribbon 14 travelling through the cassette end arm portion 18 also vertically moves with the latter. In this manner, printing operation is carried out while the ink ribbon 14 travels in the direction of the arrow A and vertically moves, i.e., perpendicular to the sheet of FIG. 3. It is needless to say that the printing head 54 does not move vertically.

Figure 4:
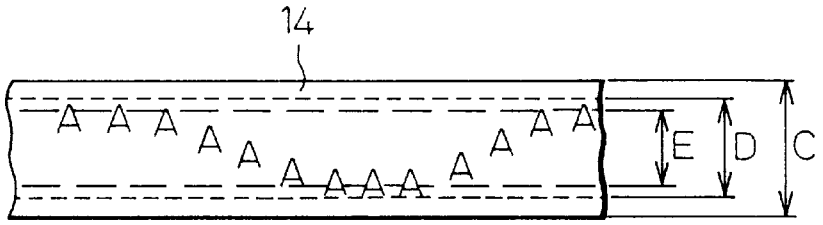
FIG. 4 is a view of the ink ribbon used for printing.

FIG. 4 shows the printed ink ribbon (the ink ribbon used for printing) 14. A trace of the printing is shown by the characters "A". The trace of the printing gradually shifts from a position near the upper end of the ink ribbon 14 to a position near the lower end of the ink ribbon 14, and from a position near the lower end of the ink ribbon 14 to a position near the upper end of the ink ribbon 14. That is, it is possible to widthwise diffuse the printing region of the ink ribbon 14, by moving the cassette body 12 in the widthwise direction of the ink ribbon 14.

Therefore, printing operation is not repeatedly carried out at a particular portion of the ink ribbon 14, so the ink ribbon 14 is not locally damaged and durability of the ink ribbon 14 increases when the ink ribbon 14 is repeatedly used. For example, an operational life of a conventional ink ribbon cassette having no actuating means ends when six million printing points are produced, but an operational life of the ink ribbon cassette 10 having the actuating means according to the present invention is prolonged until twelve million printing points are produced. In this example, the ratio of the numbers of the teeth between the small gear 26 and the gear 28 of the cam 30 is 1:6, and the cam surface 32 is that shown in FIG. 8A. Particularly, when a ruled line is printed, a printing operation is carried out on the substantially same portion of the paper, but in this case too, the position of the ink ribbon 14 changes and the ink ribbon 14 is not locally damaged.

In addition, since the actuating mechanism for pivotably moving the cassette body 12 to widthwise diffuse the printing region of the ink ribbon 14 functions by receiving a rotational force from the printer 50 to rotate the ink ribbon 14, it is not necessary to add a special motor or solenoid to pivotably move the cassette body. Also, since the actuating mechanism can be constructed using an existing element such as the ribbon feed roller 20, the arrangement of the actuating mechanism for pivotably moving the cassette body 12 is simple. Also, since the actuating mechanism can be incorporated in the cassette body 12, it is not necessary to modify the printer itself, and it is possible to mount the ink ribbon cassette 10 according to the present invention to a printer, in place of a conventional ink ribbon cassette having no such actuating mechanism.

In FIG. 4, the width of the ink ribbon 14 is shown by the character "C", and the width of the printing region of the ink ribbon 14 is shown by the character "D". Also, the width of the ink supply region is shown by the character "E". Here, the width E of the ink supply region is smaller than the width D of the printing region. For example, the width C of the ink ribbon 14 is 13 mm, the width D of the printing region is 7.5 mm, and the width E of the ink supply region is 5.5 mm.

In FIG. 3, the cassette body 12 includes an ink tank in which a felt-like ink supply element 36 with ink impregnated therein is housed. The ink supply element 36 has a lower density felt portion and a higher density felt portion, and the higher density felt portion is arranged in contact the ribbon feed roller 22 which is the driven roller. Therefore, ink is supplied to the ink ribbon 14 through the ink supply element 36 and the ribbon feed roller 22.

The width E of the ink supply region corresponds to the width of the end of the ink supply element 36 made in contact the ribbon feed roller 22. The ink ribbon is made from a material through which ink is readily permeable. If the width E of the ink supply region is identical to the width D of the printing region, ink permeates and is accumulated in the regions above and below the printing region, and ink then permeates from those regions into the upper and lower marginal areas in the printing region so that the upper and lower edges of the printed letters becomes dark. This tendency is particularly appears when one half the printing region is used for one printing. Therefore, by arranging the width E of the ink supply region smaller than the width D of the printing region, ink permeates from those regions above and below the printing region into the upper and lower marginal areas in the printing region and ink is uniformly distributed throughout the printing region, so clean printing can be obtained.

In addition, the ink supply element 36 is arranged to supply ink to the inside of the loop of the ink ribbon 14. In the case of FIG. 3, the ink supply element 36 is in contact the driven ribbon feed roller 22 which is arranged inside the loop of the ink ribbon 14. In the cassette end arm portion 18, the printing head 54 is arranged inside the loop of the ink ribbon 14, and the printing paper is arranged outside the loop of the ink ribbon 14. By this arrangement, it is possible to prevent contamination between the vertically and horizontally moving ink ribbon and the printing paper.

Figure 5:
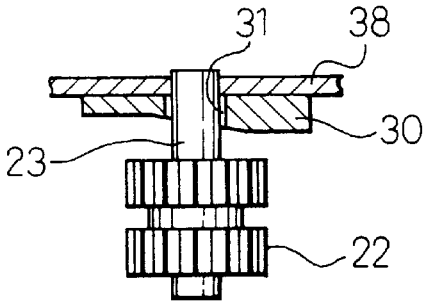
FIG. 5 is a view of the arrangement including the shaft for supporting the cam of FIG. 1.

In addition, as shown in FIG. 5, the cam 30 has a central hole 31, and the driven ribbon feed roller 22 has a shaft 23 over which the central hole 31 of the cam 30 is freely fitted. By this arrangement, it is not necessary to provide a special shaft for the cam 30 and the total arrangement becomes simple. Also, since the cam 30 and the ribbon feed roller 22 rotate at the different speeds from each other but the rotational directions are identical to each other, interference between them is small and there is no practical problem.

Figure 6:
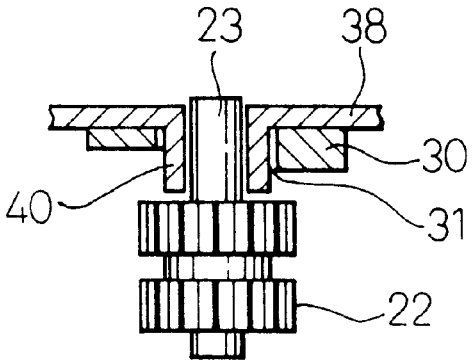
FIG. 6 is a view of another example of the arrangement for supporting the cam.

FIG. 6 shows another example of the arrangement for supporting the cam 30. The cassette body 12 has a fixed ring-shaped sleeve 40 arranged in the upper wall 38 thereof. The sleeve 40 is arranged between the shaft 23 of the driven ribbon feed roller 22 and the central hole 31 of the cam 30 so that the interior side of the sleeve 40 acts as a bearing for the shaft 23 of the driven ribbon feed roller 22 and the exterior side of the sleeve 40 acts as a shaft for supporting the cam 30. By arranging in this manner, it is possible to eliminate interference between the cam 30 and the driven ribbon feed roller 22 when a speed changing ratio between the small gear 26 and the gear 28 of the cam 30, and to maintain the arrangement of the driven ribbon feed roller 22 unchanged in conventional way. This is adapted for use with the arrangement of FIG. 10.

Figure 10:
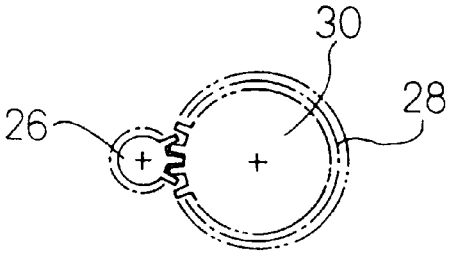
FIG. 10 is a view of another example of the small gear and the cam.

FIG. 10 shows an example in which a speed changing ratio between the small gear 26 and the gear 28 of the cam 30 can be changed. The small gear 23 has a toothed portion and a non-toothed portion circumferentially between the teeth. Therefore, the amount of the rotation of the cam 30 while the small gear 26 rotates one revolution is smaller than the amount of the rotation of the cam 30 while the small gear 26 having the teeth on the full periphery thereof rotates one revolution, so it is possible to increase the speed changing ratio between the small gear 26 and the cam 30. If the speed changing ratio becomes greater, the period of the pivotal movement of the ink ribbon cassette 10 becomes greater and the characteristics of the vertical movement of the printings of FIG. 4 changes.

The characteristics of the vertical movement of the printings can be changed by the shape of the cam surface 32 of the cam 30.

Figure 7A:
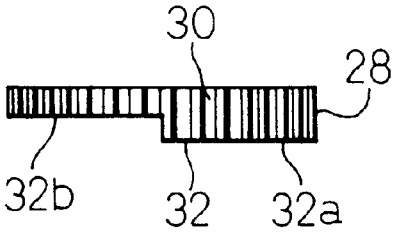
FIG. 7A is a side view of the cam having the gear and the cam surface.
Figure 7B:
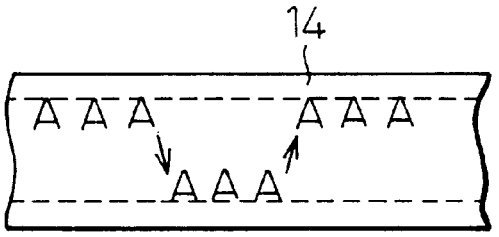
FIG. 7B is a plan view of the ink ribbon used for printing with the cam of FIG. 7A.

In FIGS. 7A and 7B, the cam 30 is arranged such that the cam surface 32 has a higher portion 32*a* and a lower portion 32*b* with vertical connecting portions between the higher and lower portions 32*a* and 32*b*. By this arrangement, it is possible to avoid the concentration of the printings on the central portion of the ink ribbon 14.

Figure 8A:
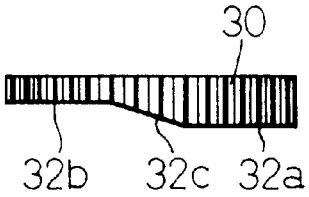
FIG. 8A is a side view of another example of the cam having the gear and the cam surface.
Figure 8B:
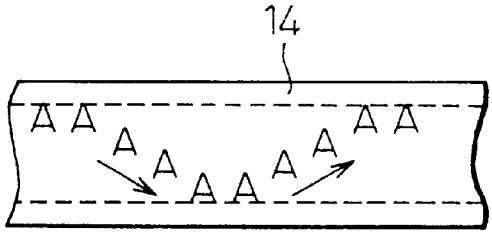
FIG. 8B is a plan view of the ink ribbon used for printing with the cam of FIG. 8A.
Figure 8C:
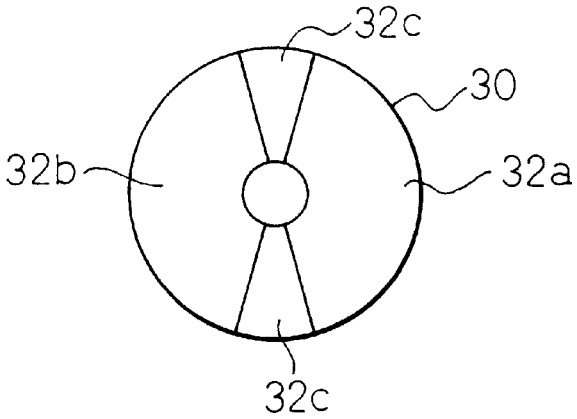
FIG. 8C is a plan view of the cam surface of FIG. 8A.

In FIGS. 8A to 8B, the cam 30 is arranged such that the cam surface 32 has a higher portion 32*a* and a lower portion 32*b* with sloped connecting portions 32*c* between the higher and lower portions 32*a* and 32*b*. The sloped connecting portions 32*c* extend in the angular range of 40 degrees, respectively. By this arrangement, it is possible to avoid the concentration of the printings on the central portion of the ink ribbon 14, and to mitigate an increase in a torque load or impact due to a sudden change in the height of the cam surface 32.

Figure 9A:
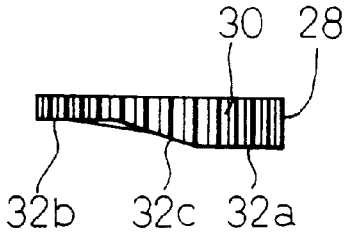
FIG. 9A is a side view of a further example of the cam having the gear and the cam surface.
Figure 9B:
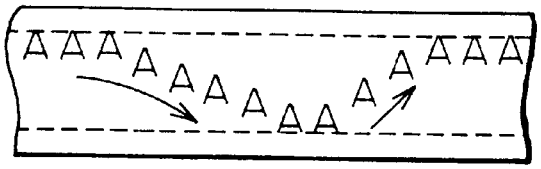
FIG. 9B is a plan view of the ink ribbon on which printing is carried out using the cam of FIG. 9A.
Figure 9C:
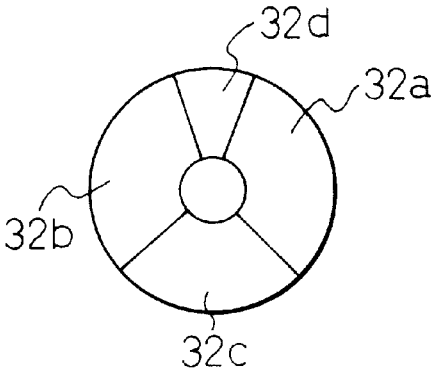
FIG. 9C is a plan view of the cam surface of FIG. 9A.

In FIGS. 9A to 9B, the cam 30 is arranged such that the cam surface 32 has a higher portion 32*a* and a lower portion 32*b* with sloped connecting portions 32*c* and 32*d* between the higher and lower portions 32*a* and 32*b*, and such that, viewed in the rotational direction of the cam surface 32, the sloped connecting portion 32*c* extending from the lower portion 32*b* to the higher portion 32*a* is longer than the sloped connecting portion 32*d* extending from the higher portion 32*a* to the lower portion 32*b*. By this arrangement, it is possible to further mitigate an increase in a torque load.

FIGS. 11 to 17 show a printer 50 having an ink ribbon cassette according to another embodiment of the present invention. In this embodiment too, the printer 50 has the ink ribbon cassette 10 mounted to a base 52 which is a part of the printer 50, and a printing head 54 (not shown). The ink ribbon cassette 10 has a cassette body 12, an ink ribbon 14 (not shown) accommodated in the cassette body 12, and a pair of ink feed rollers 20 and 22 for travelling the ink ribbon 14. Refer to the arrangement of the printing head 54, the ink ribbon 14 and other elements.

Figure 11:
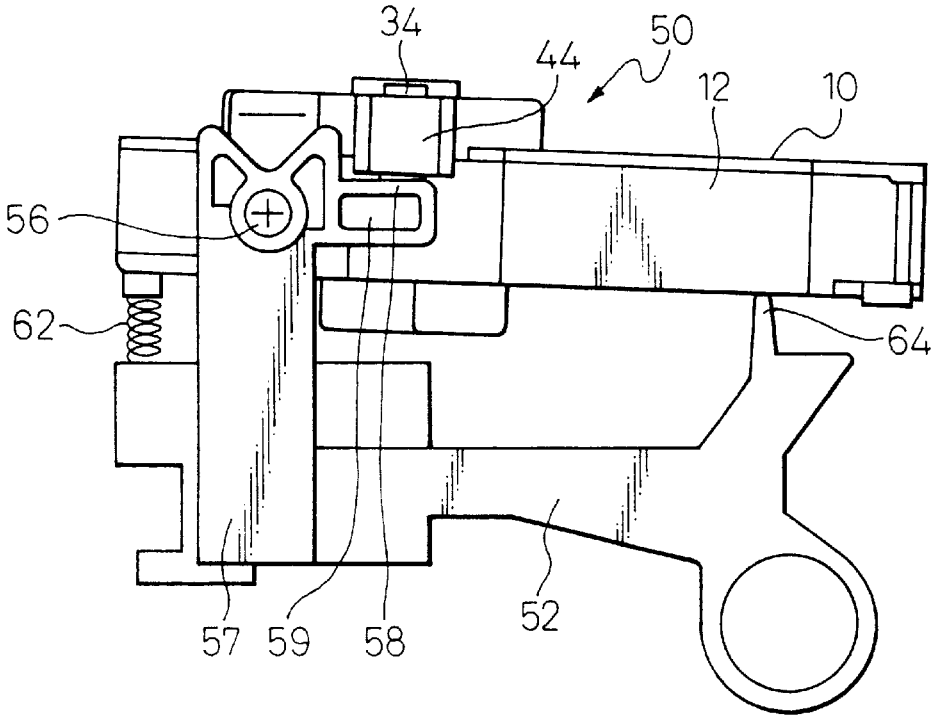
FIG. 11 is a side view of a printer having an ink ribbon cassette according to the second embodiment of the present invention.
Figure 12:
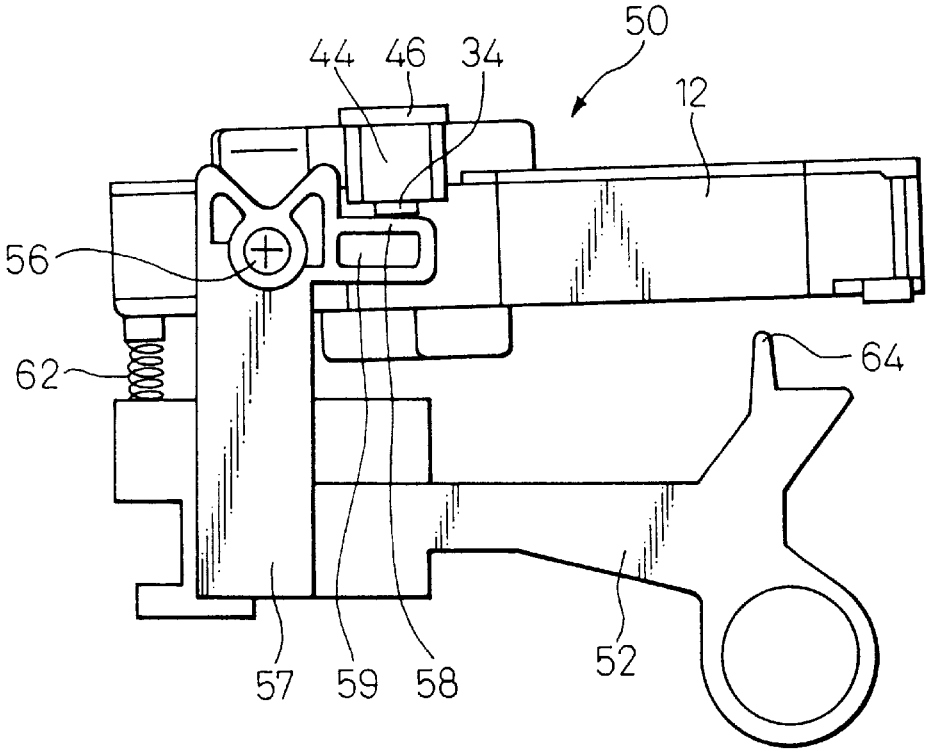
FIG. 12 is a side view of the printer of FIG. 11, with the ink cassette body of in the upper pivot position.
Figure 13:
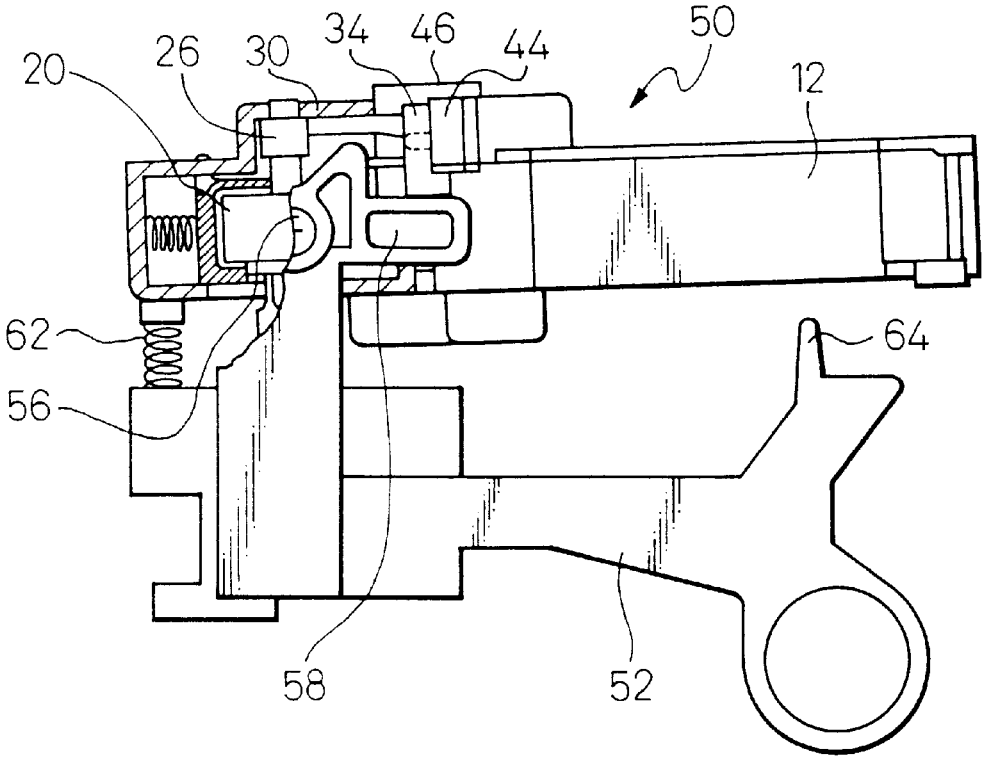
FIG. 13 is a partially cutaway side view of the printer of FIG. 12.
Figure 14:
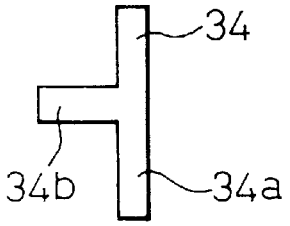
FIG. 14 is a side view of the lever of FIGS. 11 to 13.

In FIGS. 11 and 12, the base 52 of the printer 50 has a pivotable support portion 56 having a hole to rotatably receive a pin 24 laterally extending from the side of the ink ribbon cassette 10 for pivotably supporting the ink ribbon cassette 10, a support portion 58 for supporting the ink ribbon cassette 10 at a position different from the pivotable support portion 56, and a ribbon actuating means 60 (refer to the shaft 60 in FIG. 1). The ink ribbon cassette 10 is pivotable about an axis of the pin 24 relative to the base 52. A spring 62 biases the ink ribbon cassette 10 at a position on the opposite side of the support portion 58 from pivotable support portion 56.

In this embodiment, the pivotable support portion 56 is provided in a vertical arm 57 extending upwardly from the base 52, and the support portion 58 is provided as a horizontal arm 59 laterally extending from the arm 57. The design including the arms 57 and 59 were incorporated in some conventional printers, so it is possible to mount the new ink ribbon cassette 10 to the conventional printers. In addition, the base 52 has a stopper 64 to receive the ink ribbon cassette 10 when it is in the lower position.

Similar to the previous embodiment, an actuating mechanism is arranged in the cassette body 12 for pivotably moving the cassette body 12. This actuating mechanism comprises a small gear 26 provided on a shaft 21 of the ribbon feed roller 20, a cam 30 having a gear 28 engaging with the small gear 26, and a lever 34 engaging with the cam 30. The lever 34 is formed in a T-shape rotated 90 degrees from the vertical position, and has a vertical slide portion 34*a* and a horizontal support portion 34*b*.

Figure 15:
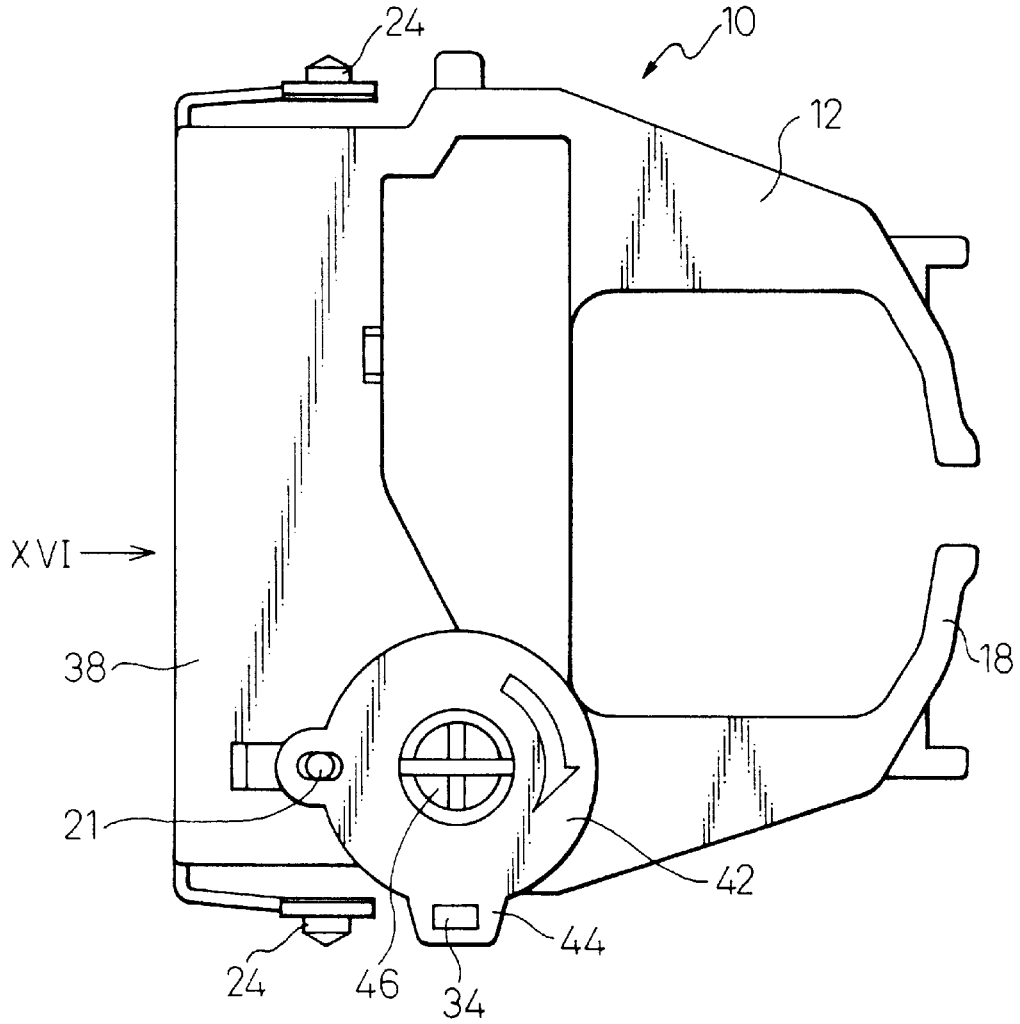
FIG. 15 is a plan view of the ink ribbon cassette of FIGS. 11 to 13.
Figure 16:
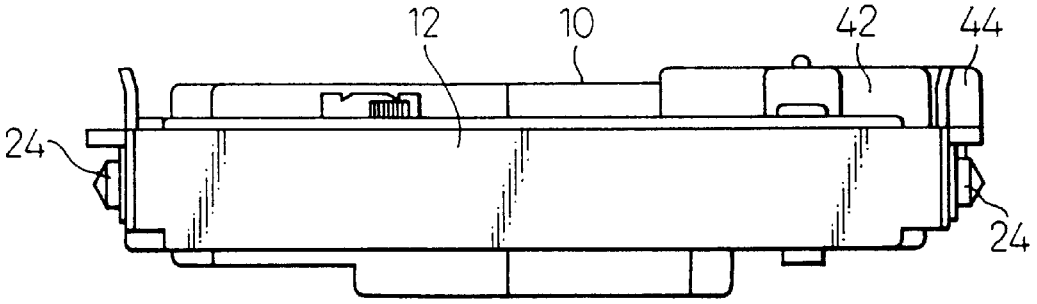
FIG. 16 is a rear view of the ink ribbon cassette, viewed in the direction of the arrow XVI of FIG. 15.
Figure 17:
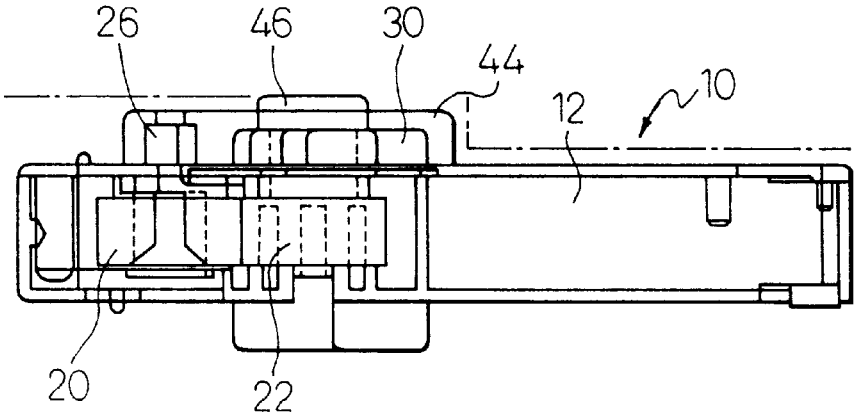
FIG. 17 is a cross-sectional view of the ink ribbon cassette.

As shown in FIGS. 15 and 16, the upper wall 38 of the cassette body 12 includes a lobed circular wall portion 42 surrounding the small gear 26 and the cam 30 from above the latter, the lobed circular wall portion 42 having a vertical wall portion 44 which laterally projects from the side surface of the cassette body 12. The vertical wall portion 44 has a vertical hole formed therethrough. The slide portion 34*a* of the lever 34 is slidably inserted in the hole of the vertical wall portion 44, and the bottom of the slide portion 34*a* of the lever 34 abuts against the support portion 58 of the base 52 (see FIG. 13). The support portion 34*b* of the lever 34 supports the cam surface 32 of the cam 30. In addition, a knob 46 is arranged in the lobed circular wall portion 42, as shown in FIG. 15. The knob 46 is fixed to the shaft 23 of the driven ribbon feed roller 22, and can be manually operated to eliminate any slack in the ink ribbon 14.

Therefore, the rotation of the ribbon actuating means 60 is transferred to the cam 30 through the ribbon feed roller 20 and the small gear 26, and the cam 30 rotates. The cam 30 and the cassette body 12 can pivotably move about the pin 24 relative to the lever 34 the downward movement of which is obstructed by the support portion 58 of the base 52. It will be understood from FIG. 13 that the center of the pivotal movement (the pin 24) of the ink ribbon cassette 10 is on the axis of the ribbon feed roller 20.

FIG. 11 shows that the cassette body 12 is at the lower pivot position and it can be seen that the upper end of the lever 34 projects from the vertical wall portion 44. In this situation, the cassette body 12 also abuts against the stopper 64. FIG. 12 shows that the cassette body 12 is at the upper pivot position and it can be seen that the lower end of the lever 34 projects from the vertical wall portion 44. In this situation, the cassette body 12 is spaced apart from the stopper 64.

The pivoting direction of the ink ribbon cassette 10 corresponds to the widthwise direction of the ink ribbon 14. The pin 24 defining a center of the pivot motion is located near the ribbon feed roller 20 and the cassette end arm portion 18 is located at the end of the cassette body 12 which is most remote from the ribbon feed roller 20. Therefore, the cassette end arm portion 18 can move sufficiently vertically in the widthwise direction of the ink ribbon 14 even if the difference between the upper and lower portions of the cam surface 32 is small.

In this way, it is possible to to widthwise diffuse the printing region of the ink ribbon 14 by moving the cassette body 12 in the widthwise direction of the ink ribbon 14, so that the ink ribbon 14 is not locally damaged and the durability of the ink ribbon 14 increases. It will be needless to say that the other features described with reference to the previous embodiment can be applied to this embodiment.

Figure 18:
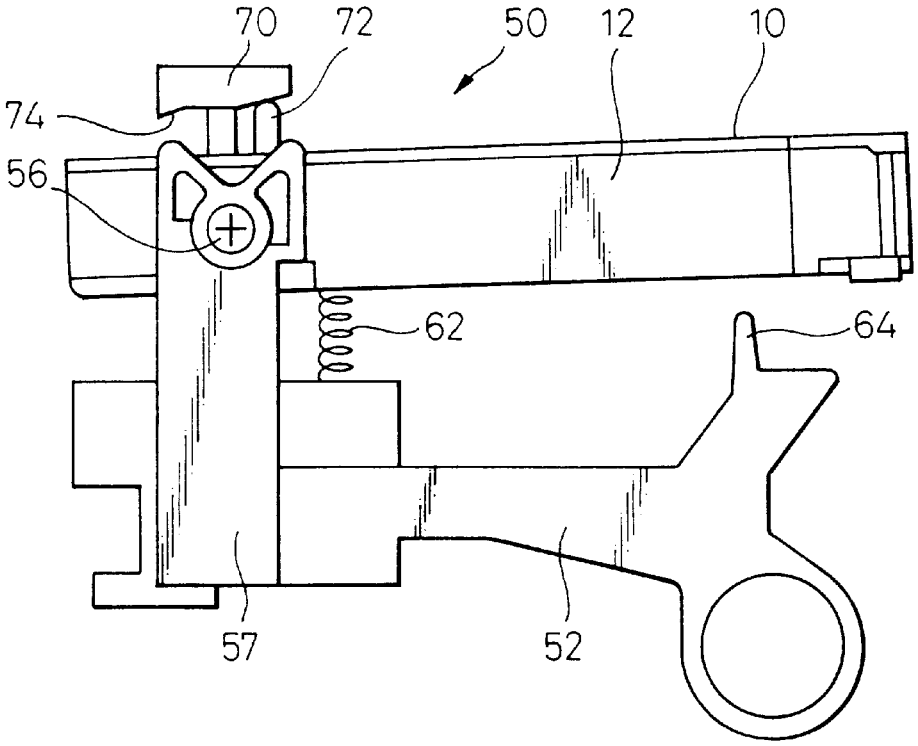
FIG. 18 is a side view of a printer having an ink ribbon cassette according to the third embodiment of the present invention.
Figure 19:
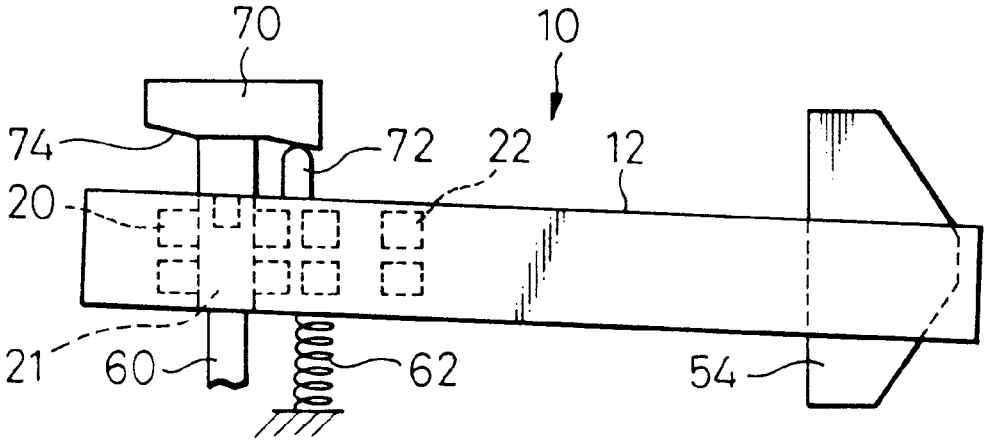
FIG. 19 is a side view of the ink cassette body of FIG. 18 in the lower pivot position.
Figure 20:
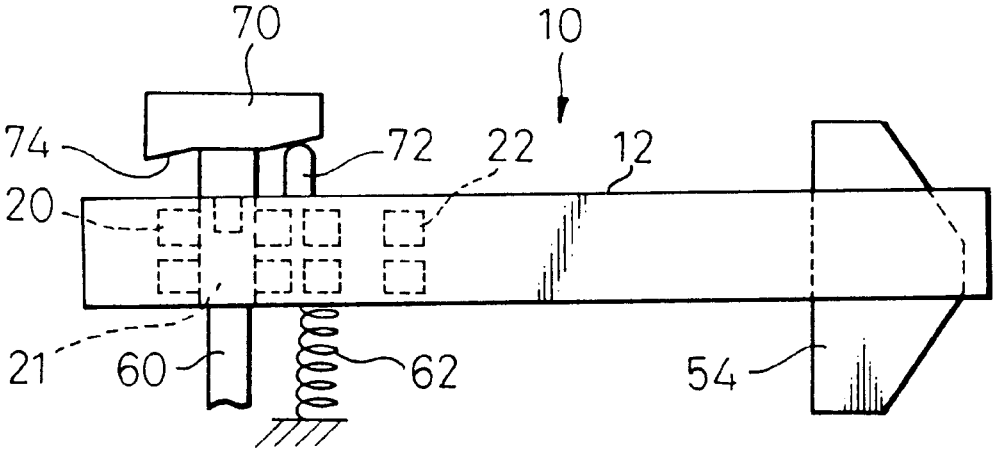
FIG. 20 is a side view of the ink cassette body of FIG. 18 in the upper pivot position.

FIGS. 18 to 20 show a further embodiment of the present invention. The printer 50 has a carrier or a carriage which can reciprocatingly move in the transverse direction of the printer, and a base 52 which is a part of the carriage is shown in FIG. 18. The printer 50 has an ink ribbon cassette 10 mounted to the base 52 and a printing head 54. The ink ribbon cassette 10 has a cassette body 12, and an ink ribbon 14 (not shown) accommodated in the cassette body 12. The ink ribbon is guided through the cassette end arm portion 18 of the cassette body 12, and printing is carried out there by the printing head 54. Similar to the previous embodiment, the cassette body 12 has a pair of ink feed rollers 20 and 22.

The cassette body 12 is pivotably supported by the base 52 of the printer 50 at a pivotable support portion 56. A spring 62 biases the cassette body 12. Ribbon actuating means 60 of the printer 50 is a drive shaft which is fitted in the hole of the ribbon feed roller when the ink ribbon cassette 10 is mounted to the printer 50. The ribbon actuating means 60 is driven by a motor arranged in the printer 50.

An actuating mechanism is arranged for pivotably moving the cassette body 12. This actuating mechanism comprises a knob 70 fixedly fitted to the shaft 21 of the ribbon feed roller 20 and upwardly projecting from the upper surface of the cassette body 12, and an upwardly extending projection 72 provided on the upper wall of the cassette body 12. A cam 74 is provided on the lower surface of the knob 70.

Therefore, the rotation of the ribbon actuating means 60 is transferred to the knob 70 and the cam 74 through the shaft 21 of the ribbon feed roller 20. Since the knob 70 and the cam 74 are maintained at an axially fixed position, the projection 72 with the cassette body 12 vertically moves following the cam profile of the cam 74 when the cam 74 rotates. Therefore, in this case too, it is possible to to widthwise diffuse the printing region of the ink ribbon 14 by moving the cassette body 12 in the widthwise direction of the ink ribbon 14.

We claim:

1. An ink ribbon cassette comprising:

a cassette body having an ink ribbon accommodated therein, said cassette body having a cassette end arm portion for guiding the ink ribbon for a printing operation by a printing head; and an actuating mechanism for moving the cassette end arm portion in the widthwise direction of the ink ribbon relative to the printing head so that a printing region of the ink ribbon becomes wider than a printing width of the printing head, wherein said cassette body is pivotably attached to a base as a part of a printer, and has a ribbon feed roller for causing the ink ribbon to travel, said actuating mechanism being arranged to receive a rotational force from a ribbon actuating means of the printer to pivotably move said cassette body, so that the printing region of the ink ribbon is widthwise diffused by pivotably moving said cassette body in the widthwise direction of the ink ribbon, and wherein said actuating mechanism for pivotally moving the cassette body comprises:

a cam receiving a rotational force from said ribbon feed roller;

a lever engaging with the cam to cause the pivotal movement of the cassette body; and a wall provided in the cassette body, said wall having a through hole in which the lever is slidably inserted.

2. An ink ribbon cassette according to claim 1, wherein said actuating mechanism comprises a small gear provided on a shaft of said ribbon feed roller, wherein said cam has a gear engaging with the small gear.

3. An ink ribbon cassette according to claim 2, wherein said small gear is integrally formed with said ribbon feed roller and said shaft, said cam is formed as a disk-like cam having the gear on the periphery thereof and a cam surface on one surface thereof, and said lever perpendicularly follows said cam surface.

4. An ink ribbon cassette according to claim 3, wherein said lever has a portion adapted to abut against said cam surface and another portion adapted to abut against said base.

5. An ink ribbon cassette according to claim 2, wherein said cassette body has a driven roller cooperating with said ribbon feed roller to feed said ink ribbon into a ribbon accommodating chamber in said cassette body, said driven roller having a shaft over which a central hole of said cam is freely fitted.

6. An ink ribbon cassette according to claim 2, wherein said cassette body has a driven roller cooperating with said ribbon feed roller to feed said ink ribbon into a ribbon accommodating chamber in said cassette body and a fixed ring-shaped sleeve, said sleeve being arranged between a shaft of said driven roller and a central hole of said cam so that the interior side of said sleeve acts as a bearing for the shaft of said driven roller and the exterior side of said sleeve acts as a shaft for supporting said cam.

7. An ink ribbon cassette according to claim 2, wherein said small gear has circumferentially discontinuous teeth portion including and a non-toothed portion between the teeth.

8. An ink ribbon cassette according to claim 3, wherein said cam surface has a higher portion and a lower portion with vertical connecting portions between the higher and lower portions.

9. An ink ribbon cassette according to claim 3, wherein said cam surface has a higher portion and a lower portion with sloped connecting portions between the higher and lower portions.

10. An ink ribbon cassette according to claim 9, wherein, viewed in the rotational direction of said cam surface, the sloped connecting portion extending from the lower portion to the higher portion is longer than the sloped connecting portion extending from the higher portion to the lower portion.

11. The ink ribbon cassette according to claim 1, wherein said lever is substantially straight.

12. The ink ribbon cassette according to claim 1, wherein said lever has a T-shape and includes a vertical slide portion and a horizontal support portion.

13. The ink ribbon cassette according to claim 12, wherein a bottom end of said vertical slide portion of said lever is adapted to abut against a support portion of said base.

14. The ink ribbon cassette according to claim 12, wherein said horizontal support portion of said lever is adapted to support a cam surface of said cam.

15. An ink ribbon cassette according to claim 1, wherein said ink ribbon comprises an ink ribbon base fabric woven from chemical fibers in a seamless form and ink impregnated in the ink ribbon base fabric.

16. An ink ribbon cassette comprising:

a cassette body having an ink ribbon accommodated therein, said cassette body having a cassette end arm portion for guiding the ink ribbon for a printing operation by a printing head; and an actuating mechanism for moving the cassette end arm portion in the widthwise direction of the ink ribbon relative to the printing head so that a printing region of the ink ribbon becomes wider than a printing width of the printing head, wherein said cassette body has an ink supply member having ink contained therein, said ink supply member having a width smaller than the width of the printing region of the ink ribbon.

17. An ink ribbon cassette according to claim 16, wherein said ink ribbon is formed in a loop, said ink supply member being arranged to supply ink to the interior side of the loop of said ink ribbon.

18. An ink ribbon cassette comprising:

a cassette body having an ink ribbon accommodated therein, said cassette body having a cassette end arm portion for guiding the ink ribbon for a printing operation by a printing head; and an actuating mechanism for moving the cassette end arm portion in the widthwise direction of the ink ribbon relative to the printing head so that a printing region of the ink ribbon becomes wider than a printing width of the printing head, wherein said cassette body is pivotably attached to a base as a part of a printer, and has a ribbon feed roller for causing the ink ribbon to travel, said actuating mechanism being arranged to receive a rotational force from a ribbon actuating means of the printer to pivotably move said cassette body, so that the printing region of the ink ribbon is widthwise diffused by pivotably moving said cassette body in the widthwise direction of the ink ribbon, and wherein said actuating mechanism comprises a cam provided in an element attached to a shaft of said ribbon feed roller, and a projection provided on an upper wall said cassette body.

19. An ink ribbon cassette according to claim 18, wherein said element having said cam comprises a knob fixedly fitted on a shaft of said ribbon feed roller.

20. A printer comprising an ink ribbon cassette, a base supporting said ink ribbon cassette, and a printing head;

said base having a pivotable support portion for pivotably supporting said ink ribbon cassette, a support portion for supporting said ink ribbon cassette at a position different from said pivotable support portion, and a ribbon actuating means; and said ink ribbon cassette including a cassette body pivotably mounted to said base at said pivotable support portion, a ribbon feed roller rotated by said ribbon actuating means for causing the ink ribbon to travel, a cassette end arm portion for guiding the ink ribbon for a printing operation by said printing head, and an actuating mechanism arranged in said cassette body to receive a rotational force from said ribbon actuating means of the printer to pivotably move said cassette body, whereby a printing region of the ink ribbon is widthwise diffused by pivotably moving said cassette body in the widthwise direction of the ink ribbon relative to the fixedly arranged printing head.

* * * * *